US005911901A

United States Patent [19]

Jacob et al.

[11] Patent Number: 5,911,901

[45] Date of Patent: Jun. 15, 1999

[54] LEATHER WATERPROOFING METHOD AND COMPOSITION

[75] Inventors: Richard E. Jacob, Shorewood; John A. Thompson, Milwaukee, both of Wis.

[73] Assignee: Hodgson Process Chemicals, Inc., Oak Creek, Wis.

[21] Appl. No.: 08/723,642

[22] Filed: Oct. 3, 1996

Related U.S. Application Data

[60] Provisional application No. 60/004,786, Oct. 4, 1995.

[51] Int. Cl.[6] ..... C14C 11/00

[52] U.S. Cl. ..... 252/8.57; 8/94.1 R; 106/2; 427/387; 427/389

[58] Field of Search ..... 252/8.57; 8/94.1 R; 427/387, 389; 106/2

[56] References Cited

U.S. PATENT DOCUMENTS

| | | | |
|---|---|---|---|
| 4,170,690 | 10/1979 | Armbruster et al. | 427/387 |
| 4,258,102 | 3/1981 | Traver et al. | 427/387 |
| 4,369,231 | 1/1983 | West et al. | 427/387 |
| 4,701,269 | 10/1987 | Bay et al. | 252/8.57 |
| 4,931,062 | 6/1990 | Bay et al. | 8/94.23 |
| 5,004,643 | 4/1991 | Caldwell | 428/246 |
| 5,209,965 | 5/1993 | Caldwell | 428/260 |
| 5,418,051 | 5/1995 | Caldwell | 428/240 |
| 5,507,960 | 4/1996 | Popa et al. | 252/8.57 |
| 5,514,419 | 5/1996 | Popa et al. | 252/8.57 |

FOREIGN PATENT DOCUMENTS

| | | | |
|---|---|---|---|
| 2101406 | 3/1972 | France | 252/8.57 |
| 443068 | 12/1974 | Russian Federation | 252/8.57 |
| 824436 | 12/1959 | United Kingdom | 252/8.57 |

OTHER PUBLICATIONS

Luvisi et al, "Alkenyl Succinic Acid–Silicone Systmes for Water–Resistant Leather", The Journal Of The American Leather Chemists Assoc. pp. 585–593 (Nov. 1996).

*Primary Examiner*—Anthony Green
*Attorney, Agent, or Firm*—Moore & Van Allen, PLLC

[57] ABSTRACT

Disclosed is a novel composition for improving the hydrophobicity of leather and leather substitutes, which comprises an aqueous dispersion of an unreacted mixture of a relatively inert dimethyl 50 cst silicon fluid, ammonium oleate, and water.

9 Claims, No Drawings

LEATHER WATERPROOFING METHOD AND COMPOSITION

This application claims the benefit of U.S. Provisional Application No. 60/004,786, filed Oct. 4, 1995.

BACKGROUND OF THE INVENTION

The present invention relates to a novel composition and method for hydrophobizing leathers and leather substitutes by treatment with an aqueous dispersion of an unreacted mixture of relatively inert dimethyl silicon and ammonium oleate, or a like ammonium salt of a fatty acid having between 12 and 22 carbon atoms.

Various methods and compositions are known in the art for enhancing the water resistance of leather and leather-like materials, such as pelts, skins, and leather substitute materials. For example, U.S. Pat. No. 4,931,062, Bay et al, discloses a process for waterproofing leather by using a polysiloxane which has been neutralized to form the salt of a carboxyl-containing polysiloxane. Hydrophobization is effected, according to Bay et al, by drumming in the conventional manner, during or after retaining. U.S. Pat. No. 4,701,269, also to Bay et al, discloses a similar process for treating leathers which is carried out in the aqueous phase using silicon oil and the salt of an N($C_9$–$C_{20}$-acyl)-amino acid as an emulsifier for the silicon oil.

Other methods, known in the art, for hydrophobizing articles include the use of dialkyldialkoxysilane and alkyl trialkoxysilane with a colloidal silica, as disclosed in U.S. Pat. No. 4,170,690, to Armbruster et al; the use of organopolysiloxanes having a viscosity of 1,000 to 1,000,000 centipoise in a mixed liquid suspension for colloidal, as disclosed in U.S. Pat. No. 4,258,102, to Traver et al; and dipping an article in a bath of silicone or hydrofluorocarbon, as disclosed in U.S. Pat. No. 4,369,231, to West et al. Further, other methods which have achieved a high degree of hydrophobicity of the article to be treated have been specific to those base stocks with an open web, such as fabrics. U.S. Pat. No. 5,209,695, and U.S. Pat. No. 5,004,643, both to Caldwell, disclose a method of treating an open web material, preferably a fabric, with a curable liquid silicone polymer which is applied, under pressure, to the fabric. Caldwell further requires that the silicone polymer be cured by heat or radiation. Additionally, Caldwell calls for localized shear forces sufficient to work the hydrophobizing composition into the article to be treated. A disadvantage of this process is the requirement that excess silicone polymer is present on the treated article and must be wiped away during the finishing process.

SUMMARY OF THE INVENTION

The present invention overcomes many of the problems of the prior art by employing an aqueous dispersion of a relatively inert dimethyl silicon fluid and ammonium salts of carboxylic acids. This aqueous dispersion does not require curing or pressurized application to the article to be treated. Further, the composition can be employed in low shear processes, such as drumming, which are more convenient and accessible to the leather and garment treating industry, as drumming is a known process in the art and would avoid the need for the manufacturers of water and weather resistant articles to make capital investments to improve the water and weather resistance of their goods.

Accordingly, it is an object of the present invention to provide a composition and method for improving the water and weather resistance of leathers, skins, pelts, and leather substitutes, which is in the form of an aqueous dispersion, thus eliminating the need for a costly emulsion production process for the hydrophobizing composition.

It is a further object of the invention to provide a non-curable hydrophobizing composition and method which eliminates the need for heat or radiation in a finishing process.

It is a further object of the invention to provide a hydrophobizing composition and method that can be employed in conjunction with equipment and processes known in the art, such as drumming.

It is a further object of the invention to provide a non-thixotropic hydrophobizing composition that can be employed in finishing processes of high shear.

These and other objects of the present invention will be clear from the following detailed description of the invention

DETAILED DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes oligomers; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

The composition of the present invention is an aqueous dispersion, prepared by standard processes known in the art, of an unreacted mixture of a relatively inert dimethyl silicon fluid and ammonium salts of carboxylic acids having between 12 and 22 carbon atoms. Preferably, the dimethyl silicon fluid will be of the formula $(CH_3)_3SiO[SiO(CH_3)_2]_n Si(CH_3)_3$, where n, or the degree of polymerization, will be selected to yield a fluid viscosity of approximately 50 centistokes. However, since the resulting dispersion is non-thixotropic in nature, the viscosity of the silicon fluid will not change when the dispersion is employed in the hydrophobization process; and thus, for any given hydrophobization process, it may be preferable to select n as to provide a viscosity that is more convenient for a given application. Alternately, it may be more convenient to use a commercially available dimethyl silicon; and to select from commercially available products of varying viscosities to suit the particular needs. It has been found that a dimethyl silicon fluid having a viscosity of 50 centistokes provides excellent results when used in the aqueous dispersion of the present invention, which is employed for hydrophobizing leather and similar articles in a conventional drumming process, although the composition of the present invention should provide excellent results in any conventional hydrophobizing process known in the art. Further, while the dimethyl silicon fluid referred to above is preferred, many dimethylpolysiloxanes may be employed. For example, mono-, di-, tri-, alkyl-, di-alkyl-, tri-alkyl-, amino-functional-, and organo-functional-polysiloxanes should provide excellent results in a wide variety of applications. A 50 centistoke amino-functional polysiloxane, when employed in the aqueous dispersion of the present invention, will reduce the friction between metal and the treated article, which may prove useful in certain production processes. Further, amino-substituted dimethyl polysiloxanes can provide excellent adherence of the waterproofing composition to the article being treated.

Preferably, the ammonium salt of a carboxylic acid used in the aqueous dispersion of the present invention is ammonium oleate. However, ammonium salts of other carboxylic acids may be employed with excellent results. Additionally, most any fugitive alkali should perform well in place of the ammonia. Ammonium was selected because of its low toxicity; but from a performance standpoint, should be equalled in performance by most fugitive alkali components.

Particularly preferred are fugitive alkali salts of unsaturated carboxylic acids such as linolenic, and linoleic; and, alternately, ammonium salts of saturated carboxylic acids such as stearic, palmitic, and myristic. Generally, in this regard, it has been found that the ammonium salts of a carboxylic acids having between 12 and 22 carbon atoms provide the best results when used in conjunction with the present invention and method. Further, ammonium oleate is particularly preferred, as it has been found that this ammonium salt of carboxylic acid, when employed in the waterproofing composition of the instant invention, safely and effectively hydrophobizes leather stocks to make a suitable leather product. This is due to ammonium oleate's recognized relatively low degree of toxicity.

Preferably, the disclosed waterproofing composition comprises from 25% to 95% by weight of dimethyl silicon fluid, and from 0.5% to 50% by weight of an ammonium salt of a fatty acid having between 12 and 22 carbon atoms. Further, it is particularly preferred for the disclosed waterproofing composition to comprise from 62% to 72% dimethyl 50 cst silicon fluid, from 3% to 13% of ammonium oleate in a 25% aqueous solution, and the remainder water.

To be effective, the waterproofing composition must be applied to the leather stock in a hydrophobizing effective amount. Generally, this will comprise 0.5% to 25% of the waterproofing composition, based on the weight of the original leather stock. However, given the variety of available application technology known in the art, and the degree of hydrophobicity required, a much broader range of concentrations of the waterproofing compositions may be used with excellent results.

EXAMPLES

The method of the present invention and the use of the disclosed hydrophobizing composition are illustrated by way of the following example.

Example 1

Production of Lightweight. Water Resistant Leather

In the following example, all percentages are based on the weight of the original leather stock and all temperatures are in degrees Fahrenheit.

To produce a light weight water resistant leather, in a conventional drumming process, a chrome blue leather stock is used as the starting material. The stock is then washed, to remove salts, for ten minutes in water at 90°, drained, and floated to add 75% backwater. While maintaining the temperature at 90°, 0.5% sodium formate and 1.0% ammonium bicarbonate is added. These conditions are maintained for 10 minutes.

The temperature is then raised to 120°, the Ph is adjusted to 6.1, and 1% of a brown DC dye is added. These conditions are maintained for 60 minutes. Next, the temperature is adjusted to 90° and 0.125% of formic acid is added and maintained for 10 minutes. The temperature is then raised to 140°, the stock is washed in water for 10 minutes, 75% backwater is added to float the stock, and the temperature is reduced to 125°. One-half of one percent of brown DC dye and 0.5% of brown CR dye are added and the stock is maintained for 20 minutes. The temperature is then raised to 140° and 10% of a retanning agent is added. The retanning agent is a copolymer of vinyl sulfonic acid sold under the tradename Drasil 202 by the Henkel Corporation of Gulph Mills, Pa. Drumming is continued in this solution for 30 minutes.

Next, at 140°, 8% of a leather softening agent is added. The leather softening agent used is an emulsified oil of sulfosuccinate and phosphated alcohol sold under the tradename Pellan 802 by the Henkel Corporation of Gulph Mills, Pa. Drumming is continued, under these conditions, for 60 minutes.

The temperature is then reduced to 75°, 0.5% of formic acid is added, and drumming continues for 15 minutes. The temperature is then raised to 120°, 1.0% of brown B dye is added, and the process continues for 20 minutes. Two percent of waterproofing composition is then added with the drumming temperature at 120°. The waterproofing composition used is and an aqueous dispersion of an unreacted mixture comprising 67% dimethyl 50 cst silicon fluid, 8% of a 25% aqueous solution of ammonium oleate, and 25% tap water. The stock is then maintained in the process for 20 minutes.

The pH is then adjusted to 3.8, the temperature is reduced to 75°, and 1.0% of formic acid is added and maintained for 15 minutes. The drum is then drained and 75% backwater is added to refloat the stock at 100°.

Two percent of a dry chrome powder is then added and maintained for 20 minutes. The drum temperature is then increased to 120°, 0.25% of brown dye CR is added, and the process is maintained for 10 minutes.

Maintaining the temperature at 120°, 2.0% of the Pellan 802 is then added and 1.0% of the waterproofing composition discussed above is added to the drum and maintained for 15 minutes. One percent of the dry chrome powder is then added and the drumming continues for 40 minutes.

The stock is then washed in water at 75° for 15 minutes and the process is complete. The resulting lightweight leather product exhibits excellent water resistance properties, and after undergoing the Maeser Flex Test, by being subjected to at least 20,000 flexes, there is no failure or breakage of the leather on visual inspection.

For the benefit of those skilled in the art of leather chemistry, the products and procedures of Example 1 appear in Table I.

TABLE I

| Products and Procedures | Temp ° F. | % By Weight | Time (min) | Controls pH, Cut, Temp |
|---|---|---|---|---|
| WASH | 90 | 200 | 10 | |
| FLOAT | 90 | 75% | | |
| SODIUM FORMATE | 90 | .5% | 10 | |
| AMMONIUM BICARBONATE | 90 | 1% | | |
| DYE-BROWN DC | 120 | 1% | 60 | PH.6.1 |
| FORMIC ACID | 90 | .125% | 10 | |
| WASH | 140 | 200 | 10 | |
| FLOAT | 140 | 75% | | |
| DYE-BROWN DC | 125 | .5% | | |
| DYE-BROWN CR | 125 | .5% | 20 | |
| DRASIL 202 | 140 | 10% | 30 | |
| PELLAN 802 | 140 | 8% | 60 | |
| FORMIC ACID | 75 | .5% | 15 | |
| DYE-BROWN B | 120 | 1% | 10 | |
| HYDROFOIL SE | 120 | 2% | 20 | |
| FORMIC ACID | 75 | 1% | 15 | PH.3.8 |
| DRAIN/REFLOAT | 100 | 75% | | |
| CHROME PWD. | DRY | 2% | 20 | |
| DYE-BROWN CR | 120 | .25% | 10 | |
| PELLAN 802 | 120 | 2% | | |
| HYDROFOIL SE | 120 | 1% | 15 | |
| CHROME PWD. | DRY | 1% | 40 | |
| WASH | 75 | 200 | 15 | |

What is claimed is:

1. A composition for waterproofing leather, pelts and skins which comprises an aqueous dispersion of an unreacted mixture of from about 25.0% to about 95.0%, by weight, of a dimethyl silicon fluid, and from about 0.5% to about 50.0%, by weight, of fugitive alkali salts of fatty acids having from 12 to 22 carbon atoms.

2. The composition of claim 1 wherein said fugitive alkali salts of fatty acids comprise an aqueous solution of from about 5.0% to about 50.0%, by weight, of ammonium oleate.

3. The composition of claim 1 wherein said dimethyl silicon fluid is a polydimethylsiloxane polymer of the formula $$(CH_3)_3SiO[SiO(CH_3)_2]_nSi(CH_3)_3.$$

where n is such that the viscosity of said dimethyl silicon fluid is about 50 centistokes.

4. The composition of claim 1 wherein said dimethyl silicon fluid has a viscosity of about 50 centistokes.

5. A method of hydrophobizing a stock selected from the group consisting of leather, pelts and skins which comprises contacting said stock with a hydrophobizing effective amount of an aqueous dispersion of an unreacted mixture of from about 25.0% to about 95.0%, by weight, of dimethyl silicon fluid, and from about 0.5% to about 50.0%, by weight, of fugitive alkali salts of fatty acids having between 12 and 22 carbon atoms.

6. The method of claim 5 wherein said aqueous dispersion comprises an unreacted mixture of a dimethylpolysiloxane polymer having a viscosity of about 50 centistokes and ammonium oleate.

7. The method of claim 6 wherein said aqueous dispersion is drummed into said stock.

8. The method of claim 7 wherein said drumming occurs at a temperature of about 120° F. for a treatment time of about 15 minutes to about 20 minutes.

9. The method of claim 8 wherein said stock is a chrome blue leather stock.

* * * * *